US006634929B1

(12) United States Patent
Visser

(10) Patent No.: US 6,634,929 B1
(45) Date of Patent: Oct. 21, 2003

(54) METHOD FOR GRINDING GLASS

(75) Inventor: Robert G. Visser, Afton, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 59 days.

(21) Appl. No.: 09/553,295

(22) Filed: Apr. 20, 2000

Related U.S. Application Data

(60) Provisional application No. 60/130,813, filed on Apr. 23, 1999.

(51) Int. Cl.[7] ..... B24B 1/00

(52) U.S. Cl. ..... 451/41; 451/28; 451/42; 451/36; 451/63; 451/59

(58) Field of Search ..... 451/41, 36, 63, 451/59, 42, 28, 54

(56) References Cited

U.S. PATENT DOCUMENTS

| | | | | |
|---|---|---|---|---|
| 3,916,584 A | | 11/1975 | Howard et al. | |
| 4,311,489 A | | 1/1982 | Kressner | |
| 4,609,581 A | | 9/1986 | Ott | |
| 4,652,275 A | | 3/1987 | Bloecher et al. | |
| 4,735,632 A | | 4/1988 | Oxman et al. | |
| 4,751,138 A | | 6/1988 | Tumey et al. | |
| 4,773,920 A | | 9/1988 | Chasman et al. | |
| 4,799,939 A | | 1/1989 | Bloecher et al. | |
| 4,903,440 A | | 2/1990 | Larson et al. | |
| 5,152,917 A | | 10/1992 | Pieper et al. | |
| 5,219,462 A | | 6/1993 | Bruxvoort et al. | |
| 5,236,472 A | | 8/1993 | Kirk et al. | |
| 5,254,194 A | | 10/1993 | Ott et al. | |
| 5,256,170 A | | 10/1993 | Harmer et al. | 51/293 |
| 5,341,609 A | | 8/1994 | Gorsuch et al. | 51/399 |
| 5,368,619 A | | 11/1994 | Culler | 51/308 |
| 5,435,816 A | | 7/1995 | Spurgeon et al. | 51/295 |
| 5,453,312 A | | 9/1995 | Haas et al. | 428/143 |
| 5,500,273 A | | 3/1996 | Holmes et al. | 428/147 |
| 5,505,747 A | | 4/1996 | Chesley et al. | 51/297 |
| 5,549,961 A | | 8/1996 | Haas et al. | 428/143 |
| 5,573,447 A | | 11/1996 | Kozakai et al. | 451/41 |
| 5,580,647 A | | 12/1996 | Larson et al. | 428/245 |
| 5,672,097 A | | 9/1997 | Hoopman | 451/526 |
| 5,692,950 A | * | 12/1997 | Rutherford et al. | 451/552 |
| 5,733,178 A | * | 3/1998 | Ohishi | 451/41 |
| 5,876,268 A | * | 3/1999 | Lamphere et al. | 451/41 |
| 5,888,119 A | * | 3/1999 | Christianson et al. | 451/41 |
| 5,958,794 A | | 9/1999 | Bruxvoort et al. | 438/692 |

FOREIGN PATENT DOCUMENTS

| | | | |
|---|---|---|---|
| GB | 2 255 636 | 11/1992 | B24B/49/12 |
| GB | 2 256 606 | 12/1992 | B24B/47/22 |
| JP | 28-46358 | 4/1991 | |
| WO | WO 95/07797 | 3/1995 | |
| WO | WO 95/19242 | 7/1995 | |
| WO | WO 95/22436 | 8/1995 | |
| WO | WO 97/06928 | 2/1997 | |
| WO | WO 98/10896 | 3/1998 | |
| WO | WO 98/39142 | 9/1998 | |

OTHER PUBLICATIONS

Komanduri et al., "Technological Advances in Fine Abrasive Processes," Annals of the CIRP, vol. 46/2, pp. 545–569, 1997.

Produce Brochure, 3M 60–4400–4245–9 (971)JR, 1997.

* cited by examiner

*Primary Examiner*—George Nguyen
(74) *Attorney, Agent, or Firm*—Daniel R. Pastirik

(57) ABSTRACT

A method of grinding a glass or other workpiece is described comprising the steps of: contacting a grinding layer of a flexible abrasive article with the surface of a glass workpiece, the grinding layer comprising abrasive grit dispersed in a bonding matrix, the matrix attached to a flexible backing; and moving the grinding layer of the flexible abrasive article and the surface of the glass workpiece relative to one another at a velocity of at least about 16.5 meters per second to provide a final surface roughness Ra less than about 0.030 micrometer.

43 Claims, 1 Drawing Sheet

METHOD FOR GRINDING GLASS

This application claims priority to U.S. Provisional Patent Application No. 60/130,813, filed Apr. 23, 1999.

The present invention relates to a method for grinding glass and other surfaces.

BACKGROUND OF THE INVENTION

Glass articles such as lenses, prisms, mirrors, CRT screens and the like may be found in any of a variety of locations including homes, offices and factories. Glass surfaces on such articles may be flat or contoured. Some glass articles include surfaces used with optical or mechanical components that require the surface to be optically clear with no visible defects or imperfections such as scratches and/or microscopic pits and the like. Contoured or curved glass surfaces such as those on CRT screens, for example, are characterized in part by the radius of the contoured surface formed in the glass forming process. During the forming process, defects such as mold lines, rough surfaces, small points and other small imperfections may be present on the outer surface of the glass. These types of imperfections, however small, can detrimentally effect the optical clarity of the glass or its desired surface flatness, and known processes have been widely used to remove these imperfections. These processes typically comprise abrasive finishing processes that can be categorized as grinding, lapping, fining and polishing.

The grinding process may be used to refine a curved contour or improve the flatness of a glass surface and to remove casting defects. This is accomplished by a rough grinding process on the glass surface using an abrasive tool. The grinding tool typically contains superabrasive particles such as diamond, tungsten carbide, cubic boron nitride or combinations thereof The grinding process is used to remove large amounts of glass quickly while leaving as fine a scratch pattern as the tooling and abrasive materials will allow. Scratches and other surface imperfections left from the rough grinding process are then removed during subsequent processing steps known as "fining" and "polishing". One problem associated with the rough grinding process is that it can impart coarse scratches and conchoidal fractures within the ground glass surface as well as cause fractures beneath the surface. These surface and subsurface imperfections can extend a significant distance beneath the ground surface. As a result of these residual imperfections, the resulting glass surface after grinding is typically not smooth enough for a direct polishing step.

As an alternative to the above described rough grinding process, so called "ductile grinding" has been developed for glass and has shown some promise for the grinding of glass and other materials such as ceramics, for example. The ductile grinding process strives to carefully control the amount of grinding force exerted on a glass surface to thereby perform the grinding step without the resulting fractures normally seen during the rough grinding step. In one mode of operation, a high speed ductile grinding process has been accomplished using abrasive grinding wheels mounted on high speed machinery with the grinding wheels comprised of very fine abrasive grit. During the process, the grinding wheel abrades the glass surface with careful control of the amount of force exerted on the glass surface by the abrasive grit within the wheels. The amount of force that the glass can tolerate without fracture is known to be influenced by the type of glass being used, the shape of the individual particles of abrasive grit, and the grinding environment.

Proper control of the force exerted by the grinding wheel has been maintained by the careful positioning of the grinding wheel against the glass surface and by limiting the force applied by the grinding wheel against the surface. Other modes of ductile grinding are also known, typically requiring a flexible abrasive article that is operated at low speeds with related material removal rates that are also very low.

Ductile grinding may be desirable because it tends to avoid much of the damage that has characterized the rough grinding process, particularly the scratches and fractures that extend beneath the surface of the glass. Although ductile grinding has been effective in avoiding certain surface defects, the ductile grinding process has inherently been inefficient and/or too costly when compared to other rough grinding processes. For example, the use of the aforementioned abrasive wheels requires high speed machinery that can fail after a certain number of hours of operation, thereby necessitating the costly replacement of substantial pieces of machinery. Other ductile grinding modes utilizing flexible abrasive articles (e.g., endless belts or flexible disks) have been inefficient because the grinding process is slow with a very low material removal rate.

Subsequent to the rough grinding step, glass fining and polishing may be accomplished with loose abrasive slurry comprising a plurality of abrasive particles dispersed in a liquid medium (e.g., water). In these known finishing processes, a slurry is pumped between the glass surface and a lap pad typically made of rubber, foam, polymeric material or the like. Both the glass work piece and the lap pad may be rotated relative to each other, and this grinding process may comprise one or more steps with each step generating a progressively finer surface finish on the glass. The fining process has been required to remove the above described surface and subsurface imperfections created by the rough grinding process.

It is desirable to further refine the ductile grinding process to allow high speed grinding with relatively low cost abrasives while avoiding machine failure. It is also desirable to provide a glass finishing process that incorporates ductile grinding for high speed operations with reduced machinery failure and with a surface finish that may quickly be further processed during the "polishing" step. It is also desirable to provide a process for grinding glass that is efficient and economical.

SUMMARY OF THE INVENTION

The present invention is directed to a method for grinding glass surfaces. In one aspect of the invention, a method of grinding a glass workpiece is provided comprising the steps of:

- contacting a grinding layer of a flexible abrasive article with the surface of a glass workpiece, the grinding layer comprising abrasive grit dispersed in a bonding matrix, the matrix attached to a flexible backing; and
- moving the grinding layer of the flexible abrasive article and the surface of the glass workpiece relative to one another at a velocity of at least about 16.5 meters per second to provide a final surface roughness Ra less than about 0.030 micrometer.

Preferably, the grinding process of the invention is performed with a liquid coolant and/or lubricant between the surface of the workpiece and the grinding layer of the abrasive article. One suitable liquid is a mixture of 20% by weight glycerol in water. The flexible abrasive article is preferably in the form of an endless belt, a web or an abrasive pad, and the grinding layer of the flexible abrasive article preferably includes composites comprised of abrasive grit in a bonding matrix with the bonding matrix affixed or adhered to a flexible backing. The composites (further described herein) are preferably in the form of truncated pyramids, but may be provided in any of a variety of configurations. The abrasive grit may be any of a variety of materials but is typically a superabrasive material and preferably comprises either single diamonds or a plurality of diamond bead abrasive particles. Useful binders preferably comprise filler in an amount from about 40 to about 60 percent by weight of the grinding layer. Diamond bead abrasive particles preferably comprise about 6% to 65% by volume diamond particles having an effective diameter of 25 microns or less with the diamond particles distributed throughout about 35% to 94% by volume of a microporous, nonfused, metal oxide matrix. Following the grinding step, the surface of the glass workpiece may be polished to provide an optically clear surface.

In another aspect, the invention provides a method of grinding a glass workpiece comprising the steps of:

contacting a grinding layer of a flexible abrasive article with the surface of a glass workpiece, the grinding layer comprising abrasive grit dispersed in a bonding matrix, the matrix attached to a flexible backing; and moving the grinding layer of the flexible abrasive article and the surface of the glass workpiece relative to one another to provide a cut rate greater than about 7 micrometers per minute and a final surface roughness Ra less than about 0.030 micrometers.

The use of certain terminology used herein will to be understood to have definitions consistent with the following:

"Precisely shaped" refers to abrasive composites formed by curing a binder precursor within a cavity of a production tool. Precisely shaped abrasive composites have a three dimensional shape defined by relatively smooth-surfaced sides that may be bounded by and joined at distinct edges having distinct edge lengths with endpoints defined by the intersections of the various sides. However, the abrasive composites may be formed as any of a variety of shapes with or without the aforementioned edges. Exemplary shapes include cylinders, domes, pyramids, rectangles, truncated pyramids, prisms, cubes, cones, truncated cones and the like. Typically, the abrasive composites will have a cross-section in the form of a triangle, square, circle, rectangle, hexagon, octagon, or the like.

The abrasive composites may also be irregularly shaped in that the sides or boundaries of the composites are slumped and not precise. An irregularly shaped abrasive composite may resemble conventional shapes such as the aforementioned cylinders, domes, pyramids, rectangles, truncated pyramids, prisms, cubes, cones, truncated cones and the like. However, the irregularly shaped abrasive composite may appear to be somewhat deformed or not fully formed. Alternatively, an irregularly shaped abrasive composite may have a three dimensional form in that it has a height, thickness and a base dimension, while not bearing a resemblance to any of the foregoing conventional shapes. In forming an irregularly shaped abrasive composite, the abrasive slurry may be first formed into a desired shape and/or pattern. Once the abrasive slurry is formed, the binder precursor in the abrasive slurry is typically cured or solidified. There is generally a time gap between forming the shape and curing the binder precursor. During this time gap, the abrasive slurry is still capable of flowing. Abrasive composites can also vary in size, pitch, or shape in a single abrasive article, as described in WO 95/07797, published Mar. 23, 1995 and WO 95/22436, published Aug. 24, 1995.

"Texture," as used herein, refers to a grinding layer on an abrasive article having any of the aforementioned three dimensional composites, whether the individual three dimensional composites are precisely shaped, irregularly shaped, or comprise a combination of precisely shaped and irregularly shaped composites. The texture may be formed from a plurality of abrasive composites which all have substantially the same shape. Similarly, the texture may be in a random pattern where the shapes of the abrasive composites differ from one to another in the same abrasive article.

"Ra" as used herein refers to a surface roughness measurement made with, for example, a Tencor P2 Long Scan Profiler (KLA Tencor; Mountain View, Calif.) with a 0.2 micrometer stylus and a 40 milligram stylus force. The scan speed is 0.02 millimeters/second and the scan sampling length is 0.25 millimeters with an evaluation length of 1.25 milimeters. The cutoff wavelength is 0.25 millimeters. Generally, the lower the Ra value, the smoother the finish.

"Conchoidal fracture" means a fracture in a glass surface having a shape roughly resembling that of a clam shell half or overlapping portions thereof.

"Ductile" as used in reference to the grinding process refers to removing material smoothly with an abrasive implement resulting in a surface containing fine striations.

In still another aspect of the invention, a method is provided for the grinding of a workpiece comprising the steps of:

contacting a grinding layer of a flexible abrasive article with the surface of the workpiece, the grinding layer comprising abrasive grit dispersed in a bonding matrix, the matrix attached to a flexible backing; and moving the grinding layer of the flexible abrasive article and the surface of the workpiece relative to one another at a velocity of at least about 16.5 meters per second to provide a final surface roughness Ra less than about 0.030 micrometer.

These and other aspects of the invention will be more fully appreciated by those skilled in the art upon further consideration of the remainder of the disclosure including the Detailed Description of the Preferred Embodiments and the appended claims.

BRIEF DESCRIPTION OF THE DRAWINGS

In describing the preferred embodiment of the invention, reference will be made to the various figures wherein.

DETAILED DESCRIPTION OF THE PREFERRED EMBODIMENT

Figure 1:
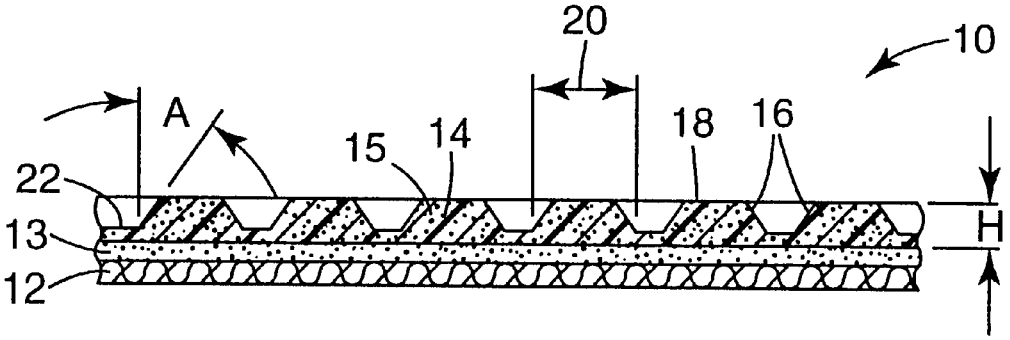
FIG. 1 is an enlarged cross section of a preferred abrasive article useful in the method of the invention.

The present invention provides a method for refining (e.g., grinding) the surface of a glass work piece with a flexible abrasive article comprising a backing and at least one three-dimensional grinding layer preferably comprising diamond particles dispersed within a matrix and affixed to a surface of the backing. Preferably, the method of the invention utilizes a flexible abrasive article with spherically shaped abrasive particles, each particle comprised of a metal oxide matrix with superabrasive grain (e.g., diamond) dispersed within the metal oxide matrix. Details of preferred methods will now be described.

Glass articles may be used in home or commercial environments for decorative or for structural purposes, for example. In the manufacture of such glass articles, at least one surface thereof may be polished to a relatively flat surface or to a slightly contoured surface. Glass articles with two very flat and parallel polished surfaces include glass computer hard drive disk substrates and glass panels for flat panel displays used in portable computers, space saving desktop computer displays and flat display television receivers. Glass articles having contoured surfaces include optical components such as lenses, prisms, mirrors, CRT (cathode ray tube) screens and the like. CRT screens are found extensively in display surfaces used in devices such as television sets, computer monitors, computer terminals and the like. CRT screens may range in size (as measured along the diagonal) from about 10 centimeters (four inches) to about 100 centimeters (40 inches) or more. CRT screens typically have a convex outer surface having two radii of curvature. In the manufacturing of such CRT screens, an abrasive process is employed to initially grind and subsequently polish the screen to provide an optically clear finished product.

The method of the present invention utilizes abrasive articles in the performance of the aforementioned grinding process. More specifically, the method of the present invention provides a high speed "ductile" grinding process for glass work pieces such as the aforementioned computer disk substrate, flat panel screens and convex CRT screens. In the method of the invention, flexible abrasive articles are utilized, preferably in the form of endless belts, to perform the grinding step. These abrasive articles include an abrasive surface that is typically affixed to a flexible backing. In one embodiment, the abrasive article comprises a backing and a three-dimensional grinding layer or grinding layer adhered or otherwise affixed to the backing, the coating comprising diamond beads dispersed within a binder and bonded to a surface of the backing. The grinding layer preferably comprises a binder formed from a binder precursor, a plurality of diamond bead abrasive particles, and a filler which comprises about 40 to about 60 percent by weight of the grinding layer. Individual components of the abrasive article will now be described in more detail.

Binders

The binder is formed from a binder precursor. The binder precursor comprises a resin that is in an uncured or unpolymerized state. During the manufacture of the abrasive article, the resin in the binder precursor is more fully polymerized, hardened or cured, such that a binder is formed. The binder precursor can comprise a condensation curable resin, an addition polymerizable resin, a free radical curable resin and/or combinations and blends thereof The preferred binder precursors are resins that polymerize via a free radical mechanism. The polymerization process is initiated by exposing the binder precursor, along with an appropriate catalyst, to an energy source such as thermal energy or radiation energy. Examples of radiation energy include electron beam, ultraviolet light or visible light.

Examples of free radical curable resins include acrylated urethanes, acrylated epoxies, acrylated polyesters, ethylenically unsaturated compounds, aminoplast derivatives having pendant unsaturated carbonyl groups, isocyanurate derivatives having at least one pendant acrylate group, isocyanate derivatives having at least one pendant acrylate group and mixtures and combinations thereof The term acrylate encompasses acrylates and methacrylates.

Acrylated urethanes are also acrylate esters of hydroxy terminated isocyanate extended polyesters or polyethers. They can be aliphatic or aromatic. Examples of commercially available acrylated urethanes include those known by the trade designations PHOTOMER (e.g., PHOTOMER 6010) from Henkel Corp. Hoboken, N.J.; EBECRYL 220 (hexafunctional aromatic urethane acrylate of molecular weight 1000), EBECRYL 284 (aliphatic urethane diacrylate of 1200 molecular weight diluted with 1,6-hexanediol diacrylate), EBECRYL 4827 (aromatic urethane diacrylate of 1600 molecular weight), EBECRYL 4830 (aliphatic urethane diacrylate of 1200 molecular weigh diluted with tetraethylene glycol diacrylate), EBECRYL 6602 (trif-Lmctional aromatic urethane acrylate of 1300 molecular weight diluted with trimethylolpropane ethoxy triacrylate), and EBECRYL 840 (aliphatic urethane diacrylate of 1000 molecular weight) from UCB Radcure Inc. Smyrna, Ga.; SARTOMER (e.g., SARTOMER 9635, 9645, 9655, 963-B80, 966-A80, etc.) from Sartomer Co., West Chester, Pa., and UVITHANE (e.g., UVITHANE 782) from Morton International, Chicago, Ill.

A urethane acrylate oligomer may be blended with an ethylenically unsaturated monomer such as monofunctional acrylate monomers, difunctional acrylate monomers, trifunctional acrylate monomers or combinations thereof The ethylenically unsaturated monomers or oligomers, or acrylate monomers or oligomers may be monofunctional, difunctional, trifunctional, tetralunctional or higher functionality. The term acrylate includes both acrylates and methacrylates. Ethylenically unsaturated binder precursors include both monomeric and polymeric compounds that contain atoms of carbon, hydrogen and oxygen, and optionally, nitrogen and the halogens. Oxygen or nitrogen atoms or both are generally present in ether, ester, urethane, amide, and urea groups. Ethylenically unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of ethylenically unsaturated monomers include methyl methacrylate, ethyl methacrylate, styrene, divinylbenzene, hydroxy ethyl acrylate, hydroxy ethyl methacrylate, hydroxy propyl acrylate, hydroxy propyl methacrylate, hydroxy butyl acrylate, hydroxy butyl methacrylate, vinyl toluene, ethylene glycol diacrylate, polyethylene glycol diacrylate, ethylene glycol dimethacrylate, hexanediol diacrylate, triethylene glycol diacrylate, trimethylolpropane triacrylate, glycerol triacrylate, pentaerthyitol triacrylate, pentaerythritol trimethacrylate, pentaerythritol tetraacrylate and pentaerythritol tetramethacrylate. Other ethylenically unsaturated resins include monoallyl, polyallyl, and polymethallyl esters and amides of carboxylic acids, such as diallyl phthalate, diallyl adipate, and N,N-diallyladipamide. Still other nitrogen containing compounds include tris(2acryl-oxyethyl) isocyanurate, 1,3,5-tri(2-methacryloxyethyl)-s-triazine, acrylamide, methylacrylamide, N-methyl-acrylamide, N,N-dimethylacrylamide, N-vinylpyrrolidone, and N-vinylpiperidone, and CMD 3700, available from Radcure Specialties. Examples of ethylenically unsaturated diluents or monomers can be found in U.S. Pat. No. 5,236,472 (Kirk et al.) and U.S. Pat. No. 5,580,647 (Larson et al.).

Additional information concerning other potential useful binders and binder precursors can be found in assignee's co-pending patent application Ser. No. 08/694,014 (filed Aug. 8, 1996), which is a continuation-in-part of patent application Ser. No. 08/557,727 (filed Nov. 13, 1995, (Bruxvoort et al.) and U.S. Pat. No. 4,773,920 (Chasman et al.).

Acrylated epoxies are diacrylate esters of epoxy resins, such as the diacrylate esters of bisphenol A epoxy resin. Examples of commercially available acrylated epoxies include CMD 3500, CMD 3600, and CMD 3700, available from Radcure Specialties, and CN103, CN104, CN 111, CN112 and CN 114 commercially available from Sartomer, West Chester, Pa.

Examples of polyester acrylates include Photomer 5007 and Photomer 5018 from Henkel Corporation, Hoboken, N.J.

The aminoplast resins have at least one pendant alpha, beta-unsaturated carbonyl group per molecule or oligomer. These unsaturated carbonyl groups can be acrylate, methacrylate or acrylamide type groups. Examples of such materials include N-(hydroxymethyl)-acrylamide, NN'-oxydimethylenebisacrylamide, ortho and para acrylamidomethylated phenol, acrylamidomethylated phenolic novolac and combinations thereof. These materials are further described in U.S. Pat. No. 4,903,440 (Larson et al.) and U.S. Pat. No. 5,236,472 (Kirk et al.).

Isocyanurate derivatives having at least one pendant acrylate group and isocyanate derivatives having at least one pendant acrylate group are further described in U.S. Pat. No. 4,652,27 (Boettcher).

The binder precursor may also comprise an epoxy resin. Epoxy resins have an oxirane and are polymerized by ring opening. Such epoxide resins include monomeric epoxy resins and polymeric epoxy reins. Examples of epoxy resins include 2,2-bis[4-(2,3-epoxypropoxy)-phenyl)propane, a diglycidyl ether of bisphenol, commercially available materials under the trade designation EPON 828, EPON 1004 and EPON IOOIF available from Shell Chemical Co., and DER-331, DER-332 and DER-334 available from Dow Chemical Co. Other epoxy resins include cycloaliphatic epoxies, glycidyl ethers of phenol formaldehyde novolac (e.g., DEN-431 and DEN428 available from Dow Chemical Co. A blend of free radical curable resins and epoxy resins are further described in U.S. Pat. No. 4,751,138 (Tumey et al.) and U.S. Pat. No. 5,256,170 (Harmer et al.).

Backing Materials

Backings serve the function of providing a support for the grinding layer. Backings useful in the invention must be capable of adhering to the binder after exposure of binder precursor to curing conditions, and are preferably flexible after said exposure so that the articles used in the inventive method may conform to surface contours, radii and irregularities in the workpiece.

In many polishing applications, the backing needs to be strong and durable so that the resulting abrasive article is long lasting. Additionally, in some polishing applications the backing needs to be strong and flexible so that the abrasive article can conform uniformly to the glass workpiece. This is typically true, when the workpiece has a shape or contour associated with it. The backing can be a polymeric film, paper, vulcanized fiber, a treated nonwoven backing or a treated cloth backing to provide these properties of strength and conformability. Examples of polymeric film include polyester film, co-polyester film, polyimide film, polyamide film and the like. A particular film backing is a polyester film having prime coating of ethylene acrylic acid on at least one surface to promote adhesion of the grinding layer to the backing.

A nonwoven, including paper, can be saturated with either a thermosetting or thermoplastic material to provide the necessary properties.

Cloth backings may also be suitable for an abrasive article of the present invention. The cloth can be a J weight, X weight, Y weight or M weight cloth. The fibers or yarns forming the cloth can be selected from the group consisting of: polyester, nylon, rayon, cotton, fiberglass and combinations thereof The cloth can be a knitted or woven cloth (e.g., drills, twilis or sateen weaves) or it can be a stitchbonded or weft insertion cloth. The greige cloth can be textured, singed, desized or any conventional treatment for a greige cloth. It is often preferred to treat a cloth backing with polymeric material to seal the cloth and thereby protect the cloth fibers. The treatment may involve one or more of the following treatments: a presize, a saturant or a backsize. One such treatment involves a presize coating applied first, followed by a backsize coating. Alternatively, a saturant coating, followed by a backsize coating. The front surface of the backing should be relatively smooth. Likewise, the treatment coat(s) should result in the cloth backing being waterproof, since glass polishing is typically done in the presence of water. Similarly, the treatment coat(s) should result in the cloth backing having sufficient strength and flexibility. One backing treatment comprises a crosslinked urethane acrylate oligomer blended with an acrylate monomer resin. It is within the scope of this invention that the cloth treatment chemistry be identical or is similar in nature to the chemistry of the binder. The cloth treatment chemistry may further comprise additives such as: fillers, dyes, pigments, wetting agents, coupling agents, plasticizers and the like.

Other treatment coatings include thermosetting and thermoplastic resins. Examples of typical thermosetting resins include phenolic resins, aminoplast resins, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins and mixtures thereof. Examples of thermoplastic resins include polyamide resins (e.g. nylon), polyester resins and polyurethane resins (including polyurethane-urea resins). One thermoplastic resin is a polyurethane derived from the reaction product of a polyester polyol and an isocyanate.

Abrasive Particles

For glass grinding, it is preferred that the abrasive article used in the method of the invention incorporate diamond abrasive beads, single diamond abrasive particles or abrasive agglomerates comprising diamonds. These diamond abrasive particles may be natural or synthetically made diamond and may be considered "resin bond diamonds", "saw blade grade diamonds", or "metal bond diamonds". The single diamonds may have a block shape associated with them or alternatively, a needle like shape. The single diamond particles may contain a surface coating such as a metal coating (for example, nickel, aluminum, copper or the like), an inorganic coating (for example, silica), or an organic coating. The abrasive article of the invention may contain a blend of diamond with other abrasive particles.

The grinding layer of the abrasive article is preferably a three-dimensional grinding layer comprised of the abrasive composites. The composites may comprise by weight anywhere between about 0.1 part abrasive particles or agglomerates to 90 parts abrasive particles or agglomerates and 10 parts binder to 99.9 parts binder, where the term "binder" includes any fillers and/or other additives other than the abrasive particles. However, due to the expense associated with diamond abrasive particles, it is preferred that the grinding layer comprise about 0.1 to 50 parts diamond or diamond containing particles or agglomerates and about 50 to 99.9 parts binder by weight. More preferably, the grinding layer comprises about 1 to 30 parts diamond or diamond containing particles or agglomerates and about 70 to 99 parts binder by weight, and even more preferably the grinding layer comprises about 1.5 to 10 parts diamond or diamond containing particles or agglomerates and about 90 to 98.5 parts binder by weight.

The grinding layer of an abrasive article of the present invention may comprise a plurality of diamond bead abrasive particles. Preferably, the diamond bead abrasive particles used in the articles of the invention comprise from about 6% to 65% by volume diamond abrasive particles having an effective diameter of 25 microns or less distributed throughout a matrix. The diamond bead abrasive particles comprise from about 35% to 94% by volume of the matrix which typically is a microporous, nonfused, metal oxide matrix having a Knoop hardness of less than 1,000, the matrix comprising at least one oxide preferably selected from the group consisting of zirconia oxide, silica oxide, alumina oxide, magnesia oxide and titania oxide. Other formulations for the matrix are contemplated as well, and the invention is not limited to the use of any particular matrix material over another.

Diamond bead abrasive particles are reported in U.S. Pat. No. 3,916,584 (Howard et al.), the disclosure of which is incorporated herein by reference. In a preferred method of manufacture, diamond abrasive particles are mixed into an aqueous sol of a metal oxide (or oxide precursor) and the resultant slurry in turn added to an agitated dehydrating liquid (e.g., 2-ethyl-1-hexanol). Water is removed from the dispersed slurry and surface tension draws the slurry into spherical composites, which are thereafter filtered out, dried, and fired. The resultant diamond bead abrasive particles are generally spherical in shape and have a size at least twice that of the diamond particles used to prepare the diamond bead abrasive particles. Typically, the individual diamonds will have a size ranging from about 0.25 to 25 micrometers, more preferably ranging from about 0.5 to 6 micrometers. The diamond bead abrasive particles typically range in size from about 5 to about 200 micrometers, preferably ranging in size from about 12 to about 50 micrometers. When diamond bead abrasive particles are incorporated into an abrasive article for purposes of the present invention, the grinding layer of the article will typically comprise about 1 to about 30 weight percent diamond bead abrasive particles, more typically about 2 to about 25 weight percent diamond bead abrasive particles. Preferably, the grinding layer comprises by about 5 to about 15 weight percent diamond bead abrasive particles, more preferably comprising about 7 to about 13 weight percent diamond bead abrasive particles.

Those skilled in the art will appreciate that the articles of the invention may include abrasive agglomerates other than the aforementioned diamond bead abrasive particles. Preferably, the agglomerates used herein will comprise diamonds or other suitable hard abrasive. Abrasive agglomerates can be made by known processes such as those detailed in U.S. Pat. Nos. 4,311,489; 4,652,275, 4,799,939, and 5,500,273.

Fillers

The grinding layer of an abrasive article of the present invention further comprises a filler. A filler is a particulate material and generally has an average particle size range between 0.01 to 50 micrometers, typically between 0.1 to 40 micrometers. A filler is added to the grinding layer in order to control the rate of erosion of the grinding layer. A controlled rate of erosion of the grinding layer during polishing is important in achieving a balance of high cut rate, consistent cut rate, and a long useful life. If the filler loading is too high, the grinding layer may erode at a rate which is too fast thereby resulting in an inefficient polishing operation (e.g., low cut and poor useful life of the abrasive article). Conversely, if the filler loading is too low, the grinding layer may erode at a rate which is too slow thereby allowing the abrasive particles to dull resulting in a low cut rate. The grinding layer of an abrasive article of the present invention comprises about 40 to about 60 weight percent filler. More preferably, the grinding layer comprises about 45 to about 60 weight percent filler. Most preferably, the grinding layer comprises about 50 to about 60 weight percent filler.

Examples of fillers which may be suitable for use in an abrasive article of the present invention include: metal carbonates (such as calcium carbonate (chalk, calcite, marl, travertine, marble and limestone), calcium magnesium carbonate, sodium carbonate, magnesium carbonate), silica (such as quartz, glass beads, glass bubbles and glass fibers) silicates (such as talc, clays (montmorillonite), feldspar, mica, calcium silicate, calcium metasilicate, sodium aluminosilicate, sodium silicate, lithium silicate, and potassium silicate) metal sulfates (such as calcium sulfate, barium sulfate, sodium sulfate, aluminum sodium sulfate, aluminum sulfate), gypsum, vermiculite, wood flour, aluminum trihydrate, carbon black, metal oxides (such as calcium oxide (lime), aluminum oxide, tin oxide (for example stannic oxide), titanium dioxide) and metal sulfites (such as calcium sulfite), thermoplastic particles (polycarbonate, polyetherimide, polyester, polyethylene, polysulfone, polystyrene, acrylonitrile-butadiene-styrene block copolymer, polypropylene, acetal polymers, polyurethanes, nylon particles) and thermosetting particles (such as phenolic bubbles, phenolic beads, polyurethane foam particles) and the like. The filler may also be a salt such as a halide salt. Examples of halide salts include sodium chloride, potassium cryolite, sodium cryolite, ammonium cryolite, potassium tetrafluoroborate, sodium tetrafluoroborate, silicon fluorides, potassium chloride, ammonium chloride and magnesium chloride. Examples of metal fillers include, tin, lead, bismuth, cobalt, antimony, cadmium, iron titanium. Other miscellaneous fillers include sulfur, organic sulfur compounds, graphite and metallic sulfides.

Preferred fillers for imparting the desired erodibility to the grinding layer include calcium metasilicate, white aluminum oxide, calcium carbonate, ammonium chloride and silica. Combinations of fillers can be used including calcium metasilicate combined with white aluminum oxide or calcium carbonate. The calcium silicate may be added at to the grinding layer at a concentration between 20 and 30 weight percent and the white aluminum oxide may be added at a concentration between 25 and 35 weight percent. When a fine surface finish is desired, it may be desirable to use a soft filler available in a small average particle size.

Additives

The grinding layer of an abrasive article of the present invention may further comprise optional additives, such as, abrasive particle surface modification additives, coupling agents, fillers, expanding agents, fibers, antistatic agents, curing agents, suspending agents, photosensitizers, wetting agents, surfactants, pigments, dyes, UV stabilizers, and anti-oxidants. The amounts of these materials are selected to provide the properties desired.

Coupling Agents

A coupling agent can provide an association bridge between the binder and the abrasive particles. Additionally the coupling agent can provide an association bridge between the binder and the filler particles. Examples of coupling agents include silanes, titanates, and zircoaluminates. There are various means to incorporate the coupling agent as known by those skilled in the art, and the present invention is not to be construed as limited or requiring the inclusion of coupling agent or the addition such an agent in any particular manner. For example, the coupling agent may be added directly to the binder precursor for the grinding layer. The grinding layer may contain anywhere from about 0 to 30%, preferably between 0.1 to 25% by weight coupling agent. Alternatively, the coupling agent may be applied to the surface of the filler particles. In yet another mode, the coupling agent is applied to the surface of the abrasive particles prior to being incorporated into the abrasive article. The abrasive particle may contain anywhere from about 0 to 3% by weight coupling agent, based upon the weight of the abrasive particle and the coupling agent. Examples of commercially available coupling agents include "AI74" and "AI230" from OSI. Still another example of a commercial coupling agent is an isopropyl triisosteroyl titanate commercially available from Kenrich Petrochemicals, Bayonne, N.J., under the trade designation "KR-TTS".

Suspending Agents

An example of a suitable suspending agent is an amorphous silica particle having a surface area less than 150 meters square/gram that is commercially available from DeGussa Corp., Ridgefield Park, N.J., under the trade name "OX-50". The addition of a small particle suspending agent to the abrasive slurry increases the effective volume of fluid by approximately the total volume of the small particles and can lower the medium to high shear viscosity of the dispersion. Moderate shear during pumping and coating of the abrasive slurry breaks up small particle chaining and/or loose flocs and lowers the viscosity of the slurry to provide a coatable dispersion. Hysterisis (thixotropy) can maintain the lowered viscosity for sufficient time to accomplish leveling of the grinding layer. The use of suspending agents is further described in the art such as, for example, U.S. Pat. No. 5,368,619.

Curing Agents

The binder precursor may further comprise a curing agent to initiate and complete the polymerization or crosslinking process such that the binder precursor is converted into a more rigid binder for the finished grinding layer. The term curing agent encompasses initiators, photoinitiators, catalysts and activators. The amount and type of the curing agent will depend largely on the chemistry of the binder precursor.

Free Radical Initiators

Polymerization of the preferred ethylenically unsaturated monomer(s) or oligomer(s) occurs via a free-radical mechanism. If the energy source is an electron beam, the electron beam generates free-radicals which initiate polymerization. However, it is within the scope of this invention to use initiators even if the binder precursor is exposed to an electron beam. If the energy source is heat, ultraviolet light, or visible light, an initiator may have to be present in order to generate free-radicals. Examples of initiators (i.e., photoinitiators) that generate free-radicals upon exposure to ultraviolet light or heat include, but are not limited to, organic peroxides, azo compounds, quinones, nitroso compounds, acyl halides, hydrazones, mercapto compounds, pyrylium compounds, imidazoles, chlorotriazines, benzoin, benzoin alkyl ethers, diketones, phenones, and mixtures thereof Examples of commercially available photoinitiators that generate free radicals upon exposure to ultraviolet light include IRGACURE 651 and IRGACURE 184 (commercially available from the Ciba Geigy Company, Hawthorne, N.J.), and DAROCUR 1173 (commercially available from Merck). Examples of initiators that generate free-radicals upon exposure to visible light can be found in U.S. Pat. No. 4,735,632. Other photoinitiators that generate free radicals upon exposure to visible light are available commercially under the trade names IRGACURE 369 and IRGACURE 819 (both commercially available from Ciba Geigy Company).

Typically, the initiator is used in amounts ranging from 0.1% to 10%, preferably 0.5% to 2% by weight, based on the weight of the binder precursor.

Additionally, it is preferred to disperse, preferably uniformly disperse, the initiator in the binder precursor prior to the addition of any particulate material, such as the abrasive particles and/or filler.

In general, it is preferred that the binder precursor be exposed to radiation energy, preferably ultraviolet light or visible light. In some instances, certain additives and/or abrasive particles will absorb ultraviolet and visible light, which makes it difficult to properly cure the binder precursor. This phenomena is especially true with ceria abrasive particles and silicon carbide abrasive particles. It has been found, quite unexpectedly, that the use of phosphate containing photoinitiators, in particular acylphosphine oxide containing photoinitiators, tend to overcome this problem. An example of such a photoinitiator is 2,4,6 trimethylbenzoyldiphenylphosphine oxide which is commercially available from BASF Corporation, Charlotte, N.C., under the trade designation LUCIRIN TPO. Other examples of commercially available acylphosphine oxides include DAROCUR 4263 and DAROCUR 4265, both commercially available from Merck.

Photosensitizers

Optionally, the grinding layer may contain photosensitizers or photoinitiator systems which affect polymerization either in air or in an inert atmosphere, such as nitrogen. These photosensitizers or photoinitiator systems include compounds having carbonyl groups or tertiary amino groups and mixtures thereof Among the preferred compounds having carbonyl groups are benzophenone, acetophenone, benzil, benzaldehyde, o-chlorobenzaldehyde, xanthone, thioxanthone, 9,10-anthraquinone, and other aromatic ketones which can act as photosensitizers. Among the preferred tertiary amines are methyldlethanolamine, ethyldiethanolamine, triethanolamine, phenylmethylethanolamine, and dimethylaminoethylbenzoate. In general, the amount of photosensitizer or photoinitiator system may vary from about 0.01% to about 10% by weight, more preferably from about 0.25 to about 4.0% by weight, based on the weight of the binder precursor. Examples of photosensitizers include QUANTICURE ITX, QUANTICURE QT-X, QUANTICURE PTX, QUANTICURE EPD, all commercially available from Biddle Sawyer Corp.

Abrasive Article

The abrasive article according to the invention includes a grinding layer. Preferably, the grinding layer is bonded, adhered or otherwise affixed to a backing. The grinding layer is preferably textured in some manner such as, for example, by having the grinding layer comprise a plurality of shaped abrasive composites. Abrasive composites can be precisely shaped or irregularly shaped and the grinding layer can include a combination of precisely shaped composites and irregularly shaped composites. It is preferred that the abrasive composites be precisely shaped.

Referring now to the drawing figures, the features of a preferred embodiment of an abrasive article 10 for use in the method of the invention is illustrated in FIG. 1. The article 10 may be provided in any of a variety of forms such as an endless belt, a pad or in a web-like format, all as known to those skilled in the art. As shown, the abrasive article 10 includes a backing 12 bearing on one major surface thereof a grinding layer comprised of a plurality of abrasive composites 16. The abrasive composites 16 include a abrasive grit dispersed within a bonding matrix such as binder 15. In one aspect, the abrasive grit is diamond bead abrasive particles 14 dispersed within the binder 15. The abrasive composites 16 further include from about 40% to about 60% filler (not shown). Preferably, the binder comprises multifunctional acrylates, most preferably a mixture of tris (hydroxyethyl) isocyanurate and trimethylolpropane triacrylate The binder 15 typically binds the abrasive composites 16 to the backing 12. Optionally, a pre-size coating or tie layer 13 may be interposed between the abrasive composites 16 and the backing 12. The abrasive composites 16 preferably have a discernible shape. Initially, it is preferred that the diamond bead abrasive particles 14 do not protrude beyond the surface of the binder 15. As the abrasive article 10 is being used to abrade a surface, the abrasive composite breaks down to reveal unused diamond bead abrasive particles 14 which then are available for abrasive grinding.

The abrasive composite can be made into any of a variety of shapes. Typically the cross sectional surface area of the base side of the shape that is in contact with the backing is larger in value than that of the distal end of the composite spaced from the backing. The shape of the composite can be selected from any of a variety of shapes such as, for example, cubic, block-like, cylindrical, prismatic, rectangular section post, pyramidal, truncated pyramidal, conical, truncated conical, cross, post-like with a flat top surface. Another shape is hemispherical and this is further described in PCT WO 95/22436. The resulting abrasive article can have a mixture of different abrasive composite shapes.

The bases of the abrasive composites can abut one another or alternatively, the bases of adjacent abrasive composites may be separated from one another by some specified distance. It is to be understood that this definition of abutting also covers an arrangement where adjacent composites share a common material land or bridge-like structure which contacts and extends between facing side walls of the composites. The material land may be formed from the same abrasive slurry used to form the abrasive composites.

One preferred shape of the abrasive composites 16 is generally a truncated pyramid having a flat top 18 and a base 20 that flares outward, as shown in FIG. 1. It is preferred that the height H of the abrasive composites 16 is constant across the coated abrasive article 10, but it is possible to have abrasive composites of varying heights. The height H of the composites can be a value from about 10 to about 1500 micrometers, preferably about 25 to about 1000 micrometers, more preferably from about 100 to about 600 micrometers and most preferably from about 300 to about 500 micrometers.

It is preferred that the bases 20 of adjacent abrasive composites be separated from one another by land area 22. It is believed that this land area 22, or separation, provides a means to allow the fluid medium to freely flow between the abrasive composites, thus contributing to a better cut rate, surface finish or increased glass surface flatness. The spacing of the abrasive composites can vary from about 0.3 abrasive composite per linear cm to about 100 abrasive composites per linear cm, preferably between about 0.4 abrasive composite per linear cm to about 20 abrasive composites per linear cm, more preferably between about 0.5 abrasive composite per linear cm to about 10 abrasive composites per linear cm, and most preferably between about 6 abrasive composites per linear cm to about 7 abrasive composites per linear cm.

In one aspect of the abrasive article, there is an areal spacing density of at least 5 abrasive composites/$cm^2$ and preferably at least 30 abrasive composites/$cm^2$. In a further embodiment of the invention, the areal spacing density of composites ranging from about less than 1 to about 12,000 abrasive composites/$cm^2$.

Where a rectangular section post or truncated pyramidal shape is used, the base 20 generally has a length of from about 100 to about 500 micrometers. The sides forming the abrasive composites may be straight or tapered. If the sides are tapered, it is generally easier to remove the abrasive composites 16 from the cavities of the production tool, as discussed below. Angle "A" in FIG. 1 is measured from an imaginary vertical line which intersects the base 20 of the abrasive composite 16 at the point where it joins the land area 22 between the abrasive composites 16 , (i.e., the imaginary line is normal to the land area 22). Angle "A" can range from about 1 degree to about 75 degrees, preferably from about 2 degrees to about 50 degrees, more preferably from about 3 degrees to about 35 degrees, and most preferably from about 5 degrees to about 15 degrees.

In one grinding procedure, the abrasive article may be provided in the form of a pad and the backing 12 of the article 10 may be attached, such as with a pressure sensitive adhesive, to a subpad made of polymeric material such as polycarbonate, for example, or to a urethane backing pad or a silicone foam pad. The pad is typically attached to a softer foam pad which provides a cushion for the abrasive article during polishing. The foam pad, including the abrasive article, is then mounted on a polisher platform or may be attached directly to a polisher platform.

Figure 2:
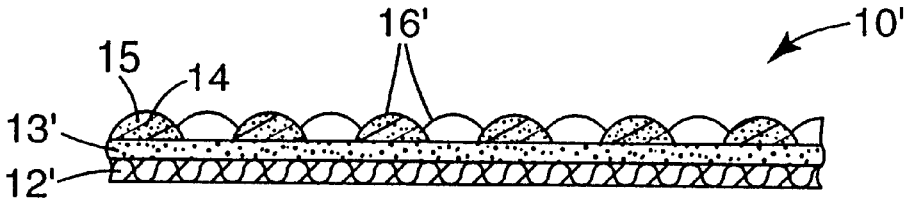
FIG. 2 is an enlarged cross section of another preferred abrasive article useful in the method of the invention.

Referring now to FIG. 2, another preferred embodiment of an abrasive article 10' in accordance with the invention is illustrated in a sectional view. In this embodiment, the abrasive composites 16' are spherical frustra. The abrasive article 10' has a woven polyester backing 12' which is sealed on one major surface with a thermoplastic polyester presize coating 13'. To the hardened presize coating 13', a slurry is applied through a screen (not shown), the slurry comprising abrasive particles and the binder precursor. The composites 16' may vary in size and shape and may be distributed randomly or unifomily on the presize coating 13'. Preferably, the composites 16' appear circular from a plan view, FIG. 3, and have the same diameter.

Regardless of the shape of the individual abrasive composites, preferably about 20% to about 90%, more preferably about 40% to about 70%, and most preferably about 50% to about 60%, of the surface area of the backing will be covered by abrasive composites. Additionally, the precisely shaped composites have a bottom portion defining a surface area not more than 50%, more preferably, not more than 25% and most preferably not more than 15% greater than the outermost surface area of the composites. The outermost surface of the composites provide a working surface of the grinding layer in that the outermost or working surface will contact the workpiece during the grinding process described herein. As the grinding process is performed, the composites will gradually be worn down, thereby exposing fresh or unused abrasive particles for continued grinding while simultaneously redefining the working surface of the abrasive article.

As mentioned, abrasive articles useful in the invention may be in the form of abrasive pads, endless belts or in a web format. Other embodiments may be know to those skilled in the art, and the invention is not to be limited to the use of one type of abrasive article over another. It should also be appreciated that abrasive articles useful in the invention may comprise more traditional coated abrasive articles in that the articles may comprise a grinding layer that does not include the aforementioned composites. Typically, the abrasive article will include a grinding layer that is textured in some manner to provide an outermost surface with discrete areas thereon capable of contacting the surface of the workpiece and channels or areas within the grinding layer that are dimensioned to direct waste or "swarf" away from the surface of the workpiece. Exemplary articles will include a grinding layer having a plurality of contact features with a dimension of greater than about 0.02 mm and less than about 5 mm, as measures in the direction of relative motion of the article in the grinding process. Such an article may have a plurality of contact areas in the working region of the article, the contact areas comprising less than 75%, preferably less than 50% of the area of the entire grinding layer. Typically at least 5%, preferably at least 25%, of the grinding layer will comprise features that are at least 10 micron below the contact surface.

Method of Making the Abrasive Article Having Precisely Shaped Abrasive Composites 5 An abrasive article of the present invention may be made by first preparing an abrasive slurry by combining together by any suitable mixing technique a binder precursor and abrasive particles, preferably diamond or diamond bead abrasive particles, a filler and desired optional additives. Examples of mixing techniques include low shear and high shear mixing, with high shear mixing being preferred. Ultrasonic energy may also be utilized in combination with the mixing step to lower the viscosity of the abrasive slurry. Typically, the abrasive particles are gradually added to the binder precursor. It is preferred that the abrasive slurry be a homogeneous mixture of binder precursor, abrasive particles, filler and optional additives. If necessary water and/or solvent can be added to lower the viscosity. The amount of air bubbles in the abrasive slurry can be minimized by pulling a vacuum either during or after the mixing step. In some instances it is preferred to heat, generally in the range from about 30° C. to about 70° C., the abrasive slurry to lower the viscosity. It is important the abrasive slurry be monitored before coating to ensure a rheology that coats well and in which the abrasive particles and other fillers do not settle before coating.

To obtain a precisely shaped grinding layer, the binder precursor is substantially solidified or cured while the abrasive slurry is present in cavities of a production tool. Alternatively, the production tool is removed from the binder precursor prior to substantial curing, resulting in slumped, somewhat irregularly shaped side walls.

The preferred method of producing the abrasive article comprising precisely-shaped abrasive composites uses a production tool containing a plurality of cavities shaped to provide the desired abrasive composites. The number of cavities per unit area results in the abrasive article having a corresponding number of abrasive composites within the same size unit area. These cavities can have any geometric shape such as a cylinder, dome, pyramid, rectangular section post, truncated pyramid, prism, cube, cone, truncated cone or the like. The cavities can be provided in any suitable shape to provide the composites described herein. The dimensions of the cavities are selected to achieve the desired number of abrasive composites per unit area. The cavities of the production tool can be present in a dot like pattern with spaces between adjacent cavities or the cavities can butt up against one another. Cavity features of adjacent rows or columns of cavities may interleave with each other or there may be gaps between adjacent rows or columns assuming that the cavities are arranged in rows and columns. The rows and columns of cavities, if present, need not be orthogonal.

The abrasive slurry can be coated into the cavities of the production tool by any conventional technique such as die coating, vacuum die coating, spraying, roll coating, transfer coating, knife coating and the like. If the production tool contains cavities that either have either flat tops or relatively straight side walls, then it is preferred to use a vacuum during coating to minimize air entrapment in or adjacent to the resin deposited within the cavities of the tool.

The production tool can be a belt, a sheet, a continuous sheet or web, a coating roll such as a rotogravure roll, a sleeve mounted on a coating roll, or die. The production tool can be composed of metal, including a nickel-plated surface, metal alloys, ceramic, or plastic. Further information on production tools, their production, materials, etc. can be found in U.S. Patent No. 5,152,917 (Pieper et al.) and U.S. Pat. No. 5,435,816 (Spurgeon et al.). One preferred production tool is a thermoplastic production tool that is embossed by a metal master.

When the abrasive slurry comprises a thermosetting binder precursor, the binder precursor must be cured or polymerized. This polymerization is generally initiated upon exposure to an energy source. In general, the amount of energy depends upon several factors such as the binder precursor chemistry, the dimensions of the abrasive slurry, the amount and type of abrasive particles, the amount and type of filler and the amount and type of the optional additives. Radiation energy is the preferred energy source. Suitable radiation energy sources include electron beam, ultraviolet light, or visible light. Electron beam radiation can be used at an energy level of about 0.1 to about 10 Mrad. Ultraviolet radiation refers to non-particulate radiation having a wavelength within the range of about 200 to about 400 nanometers, preferably within the range of about 250 to 400 nanometers. The preferred output of the radiation source is 118 to 236 Watt/cm. Visible radiation refers to non-particulate radiation having a wavelength within the range of about 400 to about 800 nanometers, preferably in the range of about 400 to about 550 nanometers.

After the production tool is coated, the backing and the abrasive slurry are brought into contact by any suitable means such that the abrasive slurry wets the front surface of the backing. The abrasive slurry is then brought into contact with the backing by means of a contact nip roll, for example. Next, some form of energy such as described herein, is transmitted into the abrasive slurry by an energy source to at least partially cure the binder precursor. For example, the production tool can be transparent material (e.g. polyester, polyethylene or polypropylene) to transmit light radiation to the slurry contained in the cavities in the tool. By the term "partial cure" it is meant that the binder precursor is polymerized to such a state that the abrasive slurry does not flow when the abrasive slurry is removed from the production tool. The binder precursor, if not fully cured, can be fully cured by any energy source after it is removed from the production tool. Other details on the use of a production tool to make the abrasive article according to this preferred method is further described in U.S. Patent No. 5,152,917 (Pieper et al.) and U.S. Pat. No. 5,435.816 (Spurgeon et al.).

In another variation of this first method, the abrasive slurry can be coated onto the backing and not into the cavities of the production tool. The abrasive slurry coated backing is then brought into contact with the production tool such that the abrasive slurry flows into the cavities of the production tool. The remaining steps to make the abrasive article are the same as detailed above. Relative to this method, it is preferred that the binder precursor is cured by radiation energy. The radiation energy can be transmitted through the backing and/or through the production tool. If the radiation energy is transmitted through either the backing or production tool then, the backing or production tool should not appreciably absorb the radiation energy. Additionally, the radiation energy source should not appreciably degrade the backing or production tool. For instance ultraviolet light can be transmitted through a polyester film backing.

Alternatively, if the production tool is made from certain materials, such as polyethylene, polypropylene, polyester, polycarbonate, poly(ether sulfone), poly(methyl methacrylate), polyurethanes, polyvinylchloride, or combinations thereof, ultraviolet or visible light can be transmitted through the production tool and into the abrasive slurry. In some instances, it is preferred to incorporate ultraviolet light stabilizers and/or antioxidants into the thermoplastic production tool. For thermoplastic based production tools, the operating conditions for making the abrasive article should be set such that excessive heat is not generated. If excessive heat is generated, this may distort or melt the thermoplastic tooling.

After the abrasive article is made, it can be flexed and/or humidified prior to converting into a suitable form/shape before the abrasive article is used.

Method of Making Abrasive Article Having Non-Precisely Shaped Abrasive Composites Another method for making the abrasive article pertains to a method in which the abrasive composites are non-precisely shaped or are irregularly shaped. In this method, the abrasive slurry is exposed to an energy source once the abrasive slurry is removed from the production tool. The first step is to coat the front side of the backing with an abrasive slurry by any conventional technique such as drop die coater, roll coater, knife coater, curtain coater, vacuum die coater, or a die coater. If desired, it is possible to heat the abrasive slurry and/or subject the slurry to ultrasonics prior to coating to lower the viscosity. Next, the abrasive slurry/backing combination is brought into contact with a production tool. The production tool can be the same type of production tool described above. The production tool comprises a series of cavities and the abrasive slurry flows into these cavities. Upon removal of the abrasive slurry from the production tool, the abrasive slurry will have a pattern associated with it; the pattern of abrasive composites is formed from the cavities in the production tool. Following removal, the abrasive slurry coated backing is exposed to an energy source to initiate the polymerization of the binder precursor and thus forming the abrasive composites. It is generally preferred that the time between release of the abrasive slurry coated backing from the production tool to curing of the binder precursor is relatively minimal. If this time is too long, the abrasive slurry will flow and the pattern will distort to such a degree that the pattern essentially disappears.

In another variation of this method, the abrasive slurry can be coated into the cavities of the production tool and not onto the backing. The backing is then brought into contact with the production tool such that the abrasive slurry wets and adheres to the backing. In this variation, for example, the production tool may be a rotogravure roll. The remaining steps to make the abrasive article are the same as detailed above.

Yet another variation is to spray or coat the abrasive slurry through a screen to generate a pattern. Then the binder precursor is cured or solidified to form the abrasive composites.

A further technique to make an abrasive article that has an grinding layer having pattern or texture associated with it to provide a backing that is embossed and then coat the abrasive slurry over the backing. The grinding layer follows the contour of the embossed backing to provide a pattern or textured coating.

Still another method to make an abrasive article is described in U.S. Pat. No. 5,219,462. An abrasive slurry is coated into the recesses of an embossed backing. The abrasive slurry contains abrasive particles, binder precursor and an expanding agent. The resulting construction is exposed to conditions such that the expanding agent causes the abrasive slurry to expand above the front surface of the backing. Next the binder precursor is solidified to form a binder and the abrasive slurry is converted into abrasive composites.

The abrasive article can be converted into any desired shape or form depending upon the desired configuration for glass polishing. This converting can be accomplished by slitting, die cutting, water jet cutting or any suitable means.

It will also be appreciated that still other abrasive articles may be suitable for use in the method of the invention. Another method to make an abrasive article is to bond a plurality of abrasive agglomerates to a backing. These abrasive agglomerates comprise a plurality of abrasive particles bonded together to form a shaped mass by means of a first binder. The resulting abrasive agglomerates are then dispersed in a second binder precursor and coated onto a backing. The second binder precursor can be applied onto the backing as knife coated, roll coated, sprayed, gravure coated, die coated, curtain coated or other conventional coating techniques and is thereafter exposed to an energy source to solidify the binder precursor to form a cured or hardened binder.

Another embodiment of the abrasive article is that described in U.S. Pat. No. 5,341,609 to Gorsuch et al., the disclosure of which is incorporated by reference herein. Similarly, abrasive belts commercially available under the trade designation 3M™ Flexible Diamond Belts and available from Minnesota Mining and Manufacturing Company of St. Paul, Minn. may be useful in the method of the invention. These belts typically provide an abrasive surface affixed to a backing wherein the abrasive is a coated abrasive belt having an abrasive layer attached to a flexible backing material. The backing has at least one flexible support and a hot-melt adhesive layer, and is in the shape of an elongated strip having abutted complementary ends with the hot-melt adhesive layer being continuous over the abutted ends to provide a splice. This coated abrasive belt is substantially the same thickness throughout its length. The width of the coated abrasive article has a width that is equal to the width of the elongated strip. The abrasive layer comprised a layer of a mesh material onto which is electrodeposited a layer of metal (e.g., nickel), and into which are embedded abrasive granules. The coated mesh material is typically laminated onto a major surface of the backing material or alternatively, in the case of a single layer backing onto the adhesive layer. Particular 3M™ Flexible Diamond Belts that are expected to show utility in the practice of the invention are belts comprising 20, 10 and 6 micrometer diamonds such as 3M™ Flexible Diamond Belt model 3M 6459J type TW/P/18.

In the treatment of glass surfaces according to the invention, the inventive process accomplishes the grinding portion of the glass finishing process wherein glass is ground substantially in the absence of the conchoidal fracture normally seen in coarse glass grinding. This is accomplished in the present invention by use of the aforementioned flexible abrasive materials and applying the abrasives to a glass surface at high speeds to provide high removal rates. More specifically, the method of the present invention is accomplished by contacting the abrasive surface of a flexible abrasive article with the surface of a glass work piece and thereafter grinding the glass surface by moving the work piece relative to the grinding layer of the flexible abrasive article. In this process, the relative velocity of the abrasive article relative to the surface of the glass is at least about 16.5 meters per second (M/sec)or 3,300 surface feet per minute (sfpm), typically between about 16.5 m/sec and about 55 m/sec (10,000 sfpm) and preferably at more than about 33 m/sec (6,700 sfpm).

Those skilled in the art will understand that the invention is not limited to a specific surface speed and that other surface speeds may be appropriate. However, the relative speed of the glass surface and the abrasive article should generally be sufficient to provide a cut rate greater than about 1 micrometers per minute, preferably between about 7 micrometers per minute and about 150 micrometers per minute to provide a final average surface roughness $R_a$ on the glass work piece of less than about 0.030 micrometer.

After grinding is complete, the surface of the ground glass may be examined under optical differential interference contrast microscopy. Preferably, at 500×magnification, the ground surface will exhibit a pattern of fine striations with little or no observable conchoidal fracture or other deep scratches extending beneath the treated surface of the glass. Typically, the average surface finish roughness $R_a$ will be less than 0.20 micrometers and, preferably less than 0.10 micrometers, more preferably less than about 0.030 micrometers.

The grinding process is preferably performed in the presence of a liquid introduced between the abrasive article and the glass surface. The liquid serves to prevent excess heating during the grinding process while also lubricating the interface between the article and the workpiece during grinding. The liquid also washes away the swarf from the polishing interface. "Swarf" is used to describe the actual debris that is abraded away by the abrasive article. Thus it is desirable to remove the swarf from the interface. Polishing in the presence of a liquid may also results in a finer finish on the workpiece surface.

Suitable liquids include water based solutions comprising one or more of the following: amines, mineral oil, kerosene, mineral spirits, water-soluble emulsions of oils, polyethylenimine, ethylene glycol, monoethanolamine, diethanolamine, triethanolamine, propylene glycol, amine borate, boric acid, amine carboxylate, pine oil, indoles, thioamine salt, amides, hexahydro-1,3,5-triethyltriazine, carboxylic acids, sodium 2-mercaptobenzothiazole, isopropanolamine, triethylenediamine tetraacetic acid, propylene glycol methyl ether, benzotriazole, sodium 2-pyridinethiol-1-oxide, hexylene glyco.

Commercially available lubricants include ,for example, those known under the trade designations BUFF-O-MINT (commercially available from Ameratron Products), CHALLENGE 300HT or 605HT (commercially available from Intersurface Dynamics), CIMTECH GL2015, CIMTECH CX-417 and CIMTECH 100 (CIMTECH is commercially available from Milacron), DIAMOND KOOL or HEAVY DUTY (commercially available from Rhodes), K-40 (commercially available from LOH Optical), QUAKER 101 (commercially available from Quaker State), SYNTILO 9930 (commercially available from Castrol Industrial), TRIM HM or TRIM VHP E320 (commercially available from Master Chemical), LONG-LIFE 20/20 (commercially available from NCH Corp), BLASECUT 883 (commercially available from Blaser Swisslube), ICF-31NF (commercially available from Du Bois), SPECTRA-COOL (commercially available from Salem), SURCOOL K-11 (commercially available from Texas Ntal), Chem Cool 9016 (comercially available from Brent America), AFG-T (commercially available from Noritake), SAFETY-COOL 130 (commercially available from Castrol Industrial), and RUSTLICK (commercially available from Devoon). These liquids may be admixed with water for use.

Attachment Means

When the abrasive article is in the form of a pad, the article may be secured to subpad or grinding platform by an attachment means such as a pressure sensitive adhesive, a hook and loop attachment, a mechanical attachment or a permanent adhesive. The attachment means should be such that the abrasive article can be firmly secured to the support pad and survive the rigors of glass polishing (wet environment, heat generation and pressures).

Representative examples of pressure sensitive adhesives suitable for this invention include latex crepe, rosin, acrylic polymers and copolymers, for example, polybutylacrylate, polyacrylate ester, vinyl ethers (e.g., polyvinyl n-butyl ether), alkyd adhesives, rubber adhesives (e.g., natural rubber, synthetic rubber, chlorinated rubber), and mixtures thereof The pressure sensitive adhesive may be coated out of water or an organic solvent. In some instances, it is preferred to use a rubber based pressure sensitive adhesive that is coated out of a non-polar organic solvent. Alternatively, the pressure sensitive adhesive may be a transfer tape.

Alternatively, the abrasive article may contain a hook and loop type attachment system to secure the abrasive article to the support pad or polisher platform. The loop fabric may be on the back side of the coated abrasive with hooks on the back up pad. Alternatively, the hooks may be on the back side of the abrasive article with the loops on the sub pad or polisher platform. This hook and loop type attachment system is further described in U.S. Pat. Nos. 4,609,581; 5,254,194 and 5,505,747 and PCT WO 95/19242.

Further details of the preferred embodiments of the invention are illustrated in the following non-limiting examples. Unless otherwise indicated, all parts, percentages, ratios, and the like are by weight.

EXAMPLES

Description of Materials

The following abbreviations are used in the identification of materials.

| | |
|---|---|
| APS | an anionic polyester surfactant, commercially available from ICI Americas, Inc., Wilmington, DE, under the trade designation "ZEPHRYM PD9000"; |
| OX-50 | a silica suspending agent having a surface area of 50 meters square/gram, commercially available from DeGussa Corporation, Dublin, OH, under the trade designation "OX-50"; |
| CC | calcium carbonate filler, commercially available from ECC International, Sylacauga, AL, under the trade designation "Micro-White 25"; |
| IRG819 | phosphine oxide, phenyl bis (2,4,6-trimethyl benzoyl) photoinitiator, commercially available from Ciba Geigy Corp., Greensboro, NC, under the trade designation "IRGACURE 819"; |
| SR368D | acrylate ester blend, commercially available from Sartomer Company, West Chester, PA, under the trade designation "SR368D"; |
| DIA | industrial diamond particles with a median size of 2.3 |

-continued

| |
|---|
| micrometer by volume, commercially available from Warren Diamond Powder Co., Inc., Olyphant, PA, under the trade designation "RB DIAMOND". |

Preparation of Diamond Bead Abrasive Particles

A slurry of 200 g of Ludox LS colloidal silica dispersion (commercially available from Dupont Co., Wilmington, Del.), 0.6 g of AY-50 surfactant (commercially available from American Cyanamid, Wayne, N.J.) and 30 g of DIA were mixed at 825–1350 rpm for 30 minutes with a sawtooth high-shear mixer having a three inch blade diameter. Approximately 18 liters (4.75 gallons) of 2-ethyl hexanol was added to a container along with 20 g of AY-50 surfactant. The slurry was added to the 2-ethyl hexanol with continuous stirring, and the mixture was agitated for 30 minutes. The 2-ethyl hexanbl was drawn off and the beads were washed with acetone, heated at 550° C. and screened to size. In this case, the beads were less than 37 $\mu$m in diameter.

Production Tool

The abrasive article was made to include abrasive composites formed in a production tool. The tool was prepared according to the method disclosed in U.S. Pat. No. 5,672,097. The production tool was a continuous web made from a polypropylene sheet material commercially available from Exxon under the trade designation "PolyPro 3445". The tool was embossed off of a nickel-plated master. The master tool was made by diamond cutting a pattern of varying dimension grooves and indentations according to the four computer programs described in the APPENDIX of the aforementioned '097 patent, and then nickel plated. The production tool comprised an array of cavities formed as inverted five sided pyramids with the mouth of the cavity forming the "base." Each cavity had a depth of about 508 micrometers but adjacent cavities varied in dimension between 15 and 45 degrees in terms of the angle made by side faces with the intersection of a plane extending normal to the plane of the tool and the material angle or apex angle of each composite was at least 60 degrees. The measured widths of bases of the pyramids used in the production tools are 670.7, 739.1, 800, 817.7, 878.5, 1025.5 micrometers respectively.

Test Procedure

Grinding equipment was used consisting of an abrasive belt drive system and a glass workpiece handling system mounted on a Moore Tool base (from Moore Specialty Tool Company, Bridgeport, Conn.) to allow for positioning and translation of the workpiece in front of the moving abrasive belt. The abrasive belt drive system was mounted directly on the fixed tool base with the workpiece handling system mounted on the translatable work table.

The abrasive belt drive was a 25.4 mm wide, 203 mm diameter diamond turned aluminum contact wheel driven by a variable speed AC motorized air bearing spindle (available from Professional Instruments Company, Minneapolis, Minn.). The belt idler consisted of a crowned 25.4mm (1 inch) wide, 203mm (8 inch) diameter aluminum wheel connected to another air bearing spindle without a drive unit. The idler wheel and its air bearing spindle were mounted on a pivoting arm which was dead weight loaded to provide belt tension. The contact wheel and idler were spaced to use a 1,067mm (42 inch) long, 25.4mm (1 inch) wide abrasive belt. The belt was conditioned by grinding the abrasive features from the face side in the area of the splice to eliminate belt chatter caused by the increased caliper of the belt at the splice. The belt speed was 33.3 n/sec.

The contact wheel, abrasive belt and idler wheel were all enclosed in a cabinet. Coolant prepared with 10 weight percent TRIM VBP E320 (Master Chemical Corporation; 501 West Boundary; Perrysburg, Ohio. 43551-1263) in water was applied at the interface between the belt and the glass workpiece at a rate of 4.2 liters/minute. The coolant was recovered from the grinding cabinet, filtered, and reused during the duration of the test.

The workpiece handling system consisted of a rotary grinding spindle—a variable speed AC motorized air bearing. A low iron soda lime silica glass workpiece was used. The outside and inside diameters of the glass workpiece were 52.4 mm and 9.5 mm respectively. The glass workpiece was attached to this spindle and rotated about it's axis at 400 rpm. The glass workpiece was positioned in front of the belt so that the line of contact with the abrasive belt went though approximately the center of the glass workpiece disk. Each side of this disk was ground for 2 minutes. Infeed of 7.5 microns/minute and crossfeed of 5mm/minute movements were provided by motor drives attached to the positioning screws on the Moore Tool base translation table. The surface roughness of the glass workpiece after grinding was measured by a Tencor P2—Long Scan Profiler (from KLA-Tencor; Mountain View, Calif.).

Example 1

TABLE 1

| Ingredients | Example 1 |
|---|---|
| SR368D | 32.0 |
| OX-50 | 0.64 |
| IRG819 | 0.32 |
| APS | 0.86 |
| CC | 58.74 |
| Diamond Bead | 7.5 |

A continuous abrasive belt was made from the slurry formulation in Table 1 using the production tool. First, the cavities of the production tool were filled with the desired abrasive slurry. A sheet of polyester film having a thickness of 0.127 mm with an ethylene acrylic acid prime coat was laminated to the abrasive slurry filled tooling using rubber squeeze rolls. Two medium pressure mercury bulbs at 400 watts per inch were used in series to cure the binder precursor of the abrasive slurry. The film/production tool laminate was passed under the UV lamps twice at a speed of 0.178 m/s. The film backing, with the structured grinding layer adhered to it, was then separated from the production tool. A 1067mm (42 inch) long, 25.4mm (1 inch) wide abrasive belt was prepared from the resulted coated abrasive. The abrasive belt was then tested using the Test Procedure.

The surface finish was evaluated with a diamond stylus profilometer, commercially available under the trade designation P-2 from KLA Tencor. The average Ra value of ten measurements was 0.026 micrometers.

The preferred embodiment of the invention has been described principally as a method for the ductile grinding of glass surfaces using flexible abrasive articles such as abrasive belts, pads and webs. Those skilled in the art will appreciate that the invention, in its broader aspects, encompasses the abrasive treatment of any of a variety of brittle substrates using a flexible article moving at a high surface velocity. In particular, brittle materials such as ceramics and even silicon wafers may be treated according to the method described herein. It will be appreciated that modifications to the described embodiments may be apparent to those skilled in the art without departing from the scope and spirit of the invention as set forth, for example, in the claims.

What is claimed is:

1. A method of grinding a glass workpiece comprising the steps of:

contacting a grinding layer of a flexible abrasive article with the surface of a glass workpiece, the grinding layer comprising abrasive grit dispersed in a bonding matrix, the matrix attached to a flexible backing; and moving the grinding layer of the flexible abrasive article and the surface of the glass workpiece relative to one another at a velocity of at least about 16.5 meters per second to provide a final surface roughness Ra less than about 0.030 micrometer.

2. The method of claim 1 wherein the flexible abrasive article is selected from the group consisting of an endless belt, a web and a pad.

3. The method of claim 2 wherein the flexible abrasive article is an endless belt.

4. The method of claim 1 wherein the grinding layer comprises abrasive composites, the composites comprised of the abrasive grit dispersed in the bonding matrix.

5. The method of claim 1 wherein the abrasive grit comprises a plurality of diamond bead abrasive particles and the grinding layer further comprises filler in an amount from about 40 to about 60 percent weight of the grinding layer.

6. The method of claim 5, wherein the diamond bead abrasive particles comprise about 6% to 65% by volume diamond particles having an effective diameter of 25 microns or less, the diamond particles distributed throughout about 35% to 94% by volume microporous, nonfused, metal oxide matrix.

7. The method of claim 6 wherein the metal oxide matrix has a Knoop hardness of less than 1,000 and comprises at least one metal oxide selected from the group consisting of zirconium oxide, silicon oxide, aluminum oxide, magnesium oxide and titanium oxide.

8. The method of claim 5 wherein the diamond bead abrasive particles range in size from about 12 to about 50 micrometers.

9. The method of claim 5, wherein the filler is selected from the group consisting of calcium metasilicate, white aluminum oxide, calcium carbonate, silica and combinations of the foregoing.

10. The method of claim 9, wherein the filler is calcium carbonate.

11. The method of claim 5, wherein the filler comprises from about 40 to about 70 weight percent of the grinding layer.

12. The method of claim 1, wherein the backing is selected from the group consisting of polymeric film, paper, vulcanized fiber, treated nonwoven, and treated cloth.

13. The method of claim 1, wherein the bonding matrix is a cured binder precursor selected from the group consisting of monofunctional acrylate monomers, difunctional acrylate monomers, trifunctional acrylate monomers, and mixtures thereof.

14. The method of claim 1, wherein the grinding layer comprises a plurality of precisely shaped abrasive composites.

15. The method of claim 14, wherein the precisely shaped abrasive composites are truncated pyramids.

16. The method of claim 15, wherein the truncated pyramids have a bottom surface defining a bottom surface area and a top surface defining a top surface area wherein the bottom surface area is not more than about 15% greater than the top surface area.

17. The method of claim 1 wherein the bonding matrix comprises a metal.

18. The method of claim 1 wherein moving the grinding layer of the flexible abrasive article and the surface of the glass workpiece relative to one another is at a velocity of at least about 33 meters per second.

19. The method of claim 1 further comprising introducing a liquid between the grinding layer of the flexible abrasive article and the surface of the glass workpiece prior to moving the grinding layer of the abrasive article and the surface of the glass workpiece relative to one another.

20. The method of claim 19 wherein the liquid comprises 10% by weight of an oil containing coolant additive dispersed in water.

21. The method of claim 1 further comprising polishing the surface of the glass workpiece to provide an optically clear surface.

22. A method of grinding a glass workpiece comprising the steps of:

contacting a grinding layer of a flexible abrasive article with the surface of a glass workpiece, the grinding layer comprising abrasive grit dispersed in a bonding matrix, the matrix attached to a flexible backing; and moving the grinding layer of the flexible abrasive article and the surface of the glass workpiece relative to one another to provide a cut rate greater than about 7 micrometers per minute and a final surface roughness Ra less than about 0.030 micrometers.

23. The method of claim 22 wherein the flexible abrasive article is selected from the group consisting of an endless belt, a web and a pad.

24. The method of claim 23 wherein the flexible abrasive article is an endless belt.

25. The method of claim 22 wherein the grinding layer comprises abrasive composites, the composites comprised of the abrasive grit dispersed in the bonding matrix.

26. The method of claim 22 wherein the grinding layer comprises a plurality of diamond bead abrasive particles and the binder comprising filler in an amount from about 40 to about 60 percent weight of the grinding layer.

27. The method of claim 26, wherein the diamond bead abrasive particles comprise about 6% to 65% by volume diamond particles having an effective diameter of 25 microns or less, the diamond particles distributed throughout about 35% to 94% by volume microporous, nonfused, metal oxide matrix.

28. The method of claim 27 wherein the metal oxide matrix has a Knoop hardness of less than 1,000 and comprises at least one metal oxide selected from the group consisting of zirconium oxide, silicon oxide, aluminum oxide, magnesium oxide and titanium oxide.

29. The method of claim 26 wherein the diamond bead abrasive particles range in size from about 12 to about 50 micrometers.

30. The method of claim 26, wherein the filler is selected from the group consisting of calcium metasilicate, white aluminum oxide, calcium carbonate, silica and combinations of the foregoing.

31. The method of claim 30, wherein the filler is calcium carbonate.

32. The method of claim 26, wherein the filler comprises from about 40 to about 70 weight percent of the grinding layer.

33. The method of claim 22, wherein the backing is selected from the group consisting of polymeric film, paper, vulcanized fiber, treated nonwoven, and treated cloth.

34. The method of claim 22, wherein the bonding matrix is a cured binder precursor selected from the group consisting of monofunctional acrylate monomers, difunctional acrylate monomers, trifunctional acrylate monomers, and mixtures thereof.

35. The method of claim 22, wherein the grinding layer comprises a plurality of precisely shaped abrasive composites.

36. The method of claim 35, wherein the precisely shaped abrasive composites are truncated pyramids.

37. The method of claim 36, wherein the truncated pyramids have a bottom surface defining a surface area and a top surface defining a surface area wherein the bottom surface area is not more than about 15% greater than the top surface area.

38. The method of claim 22 wherein the bonding matrix comprises a metal.

39. The method of claim 22 wherein moving the grinding layer of the flexible abrasive article and the surface of the glass workpiece relative to one another is at a velocity of at 16.5 meters per second.

40. The method of claim 22 further comprising introducing a liquid between the grinding layer of the flexible abrasive article and the surface of the glass workpiece prior to moving the grinding layer of th e abrasive article and the surface of the glass workpiece relative to one another.

41. The method of claim 40 wherein the liquid comprises 20% by weight of an oil containing coolant additive dispersed in water.

42. The method of claim 22 further comprising polishing the surface of the glass workpiece to provide an optically clear surface.

43. A method of grinding a glass workpiece comprising the steps:

contacting a grinding layer of a flexible abrasive article with the surface of a glass workpiece, the grinding layer comprising abrasive grit, the grinding layer attached to a flexible backing and the abrasive grit comprising a plurality of diamond bead abrasive particles dispersed in a bonding matrix; and moving the grinding layer of the flexible abrasive article and the surface of the glass workpiece relative to one another at a velocity of at least about 16. meters per second to provide a final surface roughness Ra less than about 0.030 micrometer.

* * * * *

UNITED STATES PATENT AND TRADEMARK OFFICE

CERTIFICATE OF CORRECTION

PATENT NO. : 6,634,929 B1
DATED : October 21, 2003
INVENTOR(S) : Visser, Robert G.

It is certified that error appears in the above-identified patent and that said Letters Patent is hereby corrected as shown below:

Title page,
Item [56], References Cited, OTHER PUBLICATIONS, delete “Produce” and insert -- Product --

Column 1,
Line 24, delete “effect” and insert -- affect --
Line 36, after “thereof” insert -- . --

Column 3,
Line 30, delete “to”

Column 4,
Line 18, delete “milimeters” and insert -- millimeters --

Column 5,
Lines 49 and 62, after “thereof” insert -- . --

Column 6,
Line 8, delete “weigh” and insert -- weight --
Lines 9-10, delete “trifLmctional” and insert -- trifunctional --
Line 21, after “thereof” insert -- . --
Line 24, delete “tetralunctional” and insert -- tetrafunctional --
Line 47, delete “pentaerthyitol” and insert -- pentaerythritol --
Line 53, delete “tris(2acryl-oxyethyl)” and insert -- tris(2-acryl-oxyethyl) --

Column 7,
Line 15, delete “NN’-oxydimethylenebisacrylamide” and insert -- N,N’-oxydimethylenebisacrylamide --
Line 24, delete “4,652,27 (Boettcher)” and insert -- 4,652,275 (Bloecher et al.) --

Column 8,
Line 4, after “thereof” and insert -- . --

Column 10,
Line 47, delete “at”

UNITED STATES PATENT AND TRADEMARK OFFICE

CERTIFICATE OF CORRECTION

PATENT NO. : 6,634,929 B1
DATED : October 21, 2003
INVENTOR(S) : Visser, Robert G.

It is certified that error appears in the above-identified patent and that said Letters Patent is hereby corrected as shown below:

Column 11,
Line 4, after “addition” insert -- of --
Line 62, after “thereof” and insert -- . --

Column 12,
Line 37, after “thereof” insert -- . --
Line 42, delete “methyldlethanolamine” and insert -- methyldiethanolamine --

Column 13,
Line 5, delete “a”
Lines 12-13, after “triacrylate” insert -- . --

Column 14,
Line 44, delete “unifomily” and insert -- uniformly --
Line 45, delete “FIG. 3,”

Column 15,
Line 24, delete “5”

Column 16,
Line 9, delete first instance “either”

Column 19,
Line 19, delete “micrometers” and insert -- micrometer --
Line 42, delete “results” and insert -- result --
Line 54, delete “glyco” and insert -- glycol. --

Column 20,
Line 5, delete “comercially” and insert -- commercially --
Line 26, after “therefor” insert -- . --

Column 21,
Line 20, delete “hexanbl” and insert -- hexanol --

Column 22,
Line 6, delete “33.3 n/sec.” and insert -- 33.3 m/sec. --
Line 9, delete “VBP” and insert -- VHP --
Line 24, delete “though” and insert -- through --

UNITED STATES PATENT AND TRADEMARK OFFICE

CERTIFICATE OF CORRECTION

PATENT NO. : 6,634,929 B1
DATED : October 21, 2003
INVENTOR(S) : Visser, Robert G.

It is certified that error appears in the above-identified patent and that said Letters Patent is hereby corrected as shown below:

Column 26,
Line 2, delete “th e” and insert -- the --
Line 12, after “steps” insert -- of --
Line 22, delete “16.” and insert -- 16.5 --

Signed and Sealed this

Twentieth Day of April, 2004

JON W. DUDAS
*Acting Director of the United States Patent and Trademark Office*